United States Patent [19]

Krauter et al.

[11] Patent Number: 4,495,931

[45] Date of Patent: Jan. 29, 1985

[54] ENGINE IGNITION SYSTEM

[75] Inventors: Immanuel Krauter, Erbstetten; Hartmut Schweizer, Korntal, both of Fed. Rep. of Germany

[73] Assignee: Robert Bosch GmbH, Stuttgart, Fed. Rep. of Germany

[21] Appl. No.: 520,076

[22] Filed: Aug. 3, 1983

[30] Foreign Application Priority Data

Aug. 5, 1982 [DE] Fed. Rep. of Germany ..... 3229202

[51] Int. Cl.[3] ..... F02P 1/00; F02P 1/08; F02P 9/00; F02P 3/04

[52] U.S. Cl. ..... 123/651; 123/644; 123/613

[58] Field of Search ..... 123/651, 652, 650, 618, 123/620, 613, 644; 315/209 T

[56] References Cited

U.S. PATENT DOCUMENTS

| | | | |
|---|---|---|---|
| 3,646,926 | 3/1972 | Plume, Jr. | 123/651 |
| 3,902,471 | 9/1975 | Brungsberg | 123/651 |
| 3,926,557 | 12/1975 | Callies et al. | 123/651 |
| 3,937,193 | 2/1976 | Kim | 123/644 |
| 4,106,462 | 8/1978 | Hildebrandt et al. | 123/613 |
| 4,176,644 | 12/1979 | Hellberg et al. | 123/651 |
| 4,202,304 | 5/1980 | Jundt et al. | 123/651 |
| 4,308,848 | 1/1982 | Pfaff et al. | 123/651 |

*Primary Examiner*—Raymond A. Nelli

*Attorney, Agent, or Firm*—Frishauf, Holtz, Goodman and Woodward

[57] ABSTRACT

An internal combustion engine ignition system includes an output switching transistor (7), the emitter-collector path of which is in series with the primary winding (5) of an ignition coil (6). To attain a constant amount of ignition energy in the ignition coil (6), the control current for the base of the output switching transistor (7) is supplied by a constant-current source (9), the level of the constant control current being selected such that while the ignition energy is being stored in the ignition coil (6), the saturated operation of the output switching transistor (7) is maintained.

6 Claims, 3 Drawing Figures

ENGINE IGNITION SYSTEM

The present invention relates to an ignition system for internal combustion engines, which has an output switching or control transistor, the emitter-collector path of which is in series circuit with the primary winding of an ignition coil.

BACKGROUND

An ignition system of this general type is already known from U.S. Pat. No. 4,204,508, which corresponds to German Patent Disclosure Document DE-OS No. 2 701 967. In that prior system, however, the limitation of the current flowing through the primary winding of the ignition coil and the furnishing of control current to the base of the output switching transistor are both associated with a relatively high power loss. This is because the output transistor is driven in the active domain while limiting the current through the primary winding, and during the furnishing of the control current to the base of the output transistor, a substantial amount of power is converted into heat by resistors through which this control current flows.

THE INVENTION

It is accordingly a principal object of the present invention to provide an ignition system which overcomes the foregoing deficiencies.

This is attained according to the invention by supplying the control current for the base of the output switching transistor by means of a constant-current source; and by setting the control current level such that saturated operation of the output switching or control transistor is maintained while the ignition energy is being stored.

DETAILED DESCRIPTION

Figure 1:
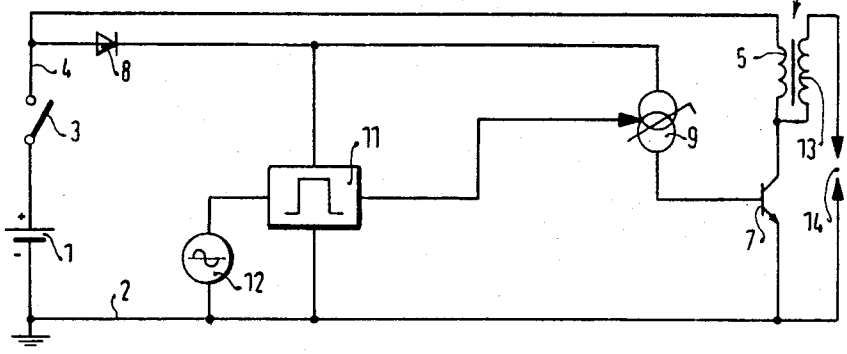
FIG. 1 illustrates a fundamental circuit diagram of the invention.

The ignition system shown in FIG. 1 is intended for use with an internal combustion engine, not shown, of a motor vehicle, again not shown. This ignition system is supplied with current from a direct-current source 1, which may be the battery of the vehicle. A line 2 connects the negative terminal of source 1 to ground and a power supply line 4 is connected to the positive terminal of source 1 and has an operating switch 3 in series therewith. The supply line 4 branches into a first current branch leading first to the primary winding 5 of an ignition coil 6 and then to the emitter-collector path of an npn power transistor 7 and then to ground line 2 or another source of ground potential. The emitter of the output switching control transistor 7 is coupled to the ground line 2. The supply line 4 also branches into a second current branch leading first to the anode of a mispolarization protection diode 8 and then to a constant-current source 9 which can be turned ON and OFF. The base of the output transistor 7 is connected to the output of the constant-current source 9. A switching unit 11 is provided to turn the constant-current source 9 ON and OFF. Switching unit 11 is coupled between the cathode of diode 8 and ground line 2. The switching unit 11, which functions in the manner of a control unit (known from U.S. Pat. No. 3,881,458, which corresponds to German Pat. No. 2 244 781), or in the manner of a regulating unit (known from U.S. Pat. No. 4,176,645, which corresponds to German Pat. No. 2 549 586) is provided for controlling the duration of the current flowing in the primary winding 5 in accordance with various operating conditions. The entire contents of U.S. Pat. No. 3,881,458 and 4,176,645 are incorporated herein by reference. The input of the switching unit 11 is connected, in order to trigger the ignition events, to a signal transducer or generator 12 which functions in the manner of an alternating-current generator. The output of switching unit 11 selectivity turns the constant-current source 9 ON and OFF. The switching unit 11 may contain a microcomputer, or it may itself be a microcomputer.

The secondary winding 13 of the ignition coil 6 is connected at one end thereof to one end of the primary winding 5, the junction between the primary winding 5 and the secondary winding 13 being coupled to the collector of output transistor 7. The other end of secondary winding 13 is connected to at least one spark plug 14.

OPERATION

The system of FIG. 1 is ready to function as soon as the operating switch 3 is closed. Let it be assumed that the signal transducer 12 has switched the constant-current source 9 ON via the switching unit 11, so that current flows into the base-emitter path of the output transistor 7 and the emitter-collector path of transistor 7 conducts and permits current to flow through the primary winding 5 of ignition coil 6. The control current for the base of the output transistor 7 has a constant level, because of the use of the constant-current source 9. The selection of the constant current is made such that—over the engine speed range occurring in practice—an amount of energy sufficient for an effective ignition spark is stored in the ignition coil 6, and during this storage process a saturated operation of the output switching transistor 7 is maintained.

At the instant of ignition, the signal transducer 12 shuts the constant-current source 9 OFF via the switching unit 11, whereupon the control current for the output transistor 7 is cut off, turning OFF transistor 7. The flow of current through the primary winding 5 is thereby interrupted, so that a high-voltage rise is produced in the secondary windings 13, which in turn produces an ignition spark at the spark plug 14.

The functional sequence described above is then repeated for each ignition event.

Figure 2:
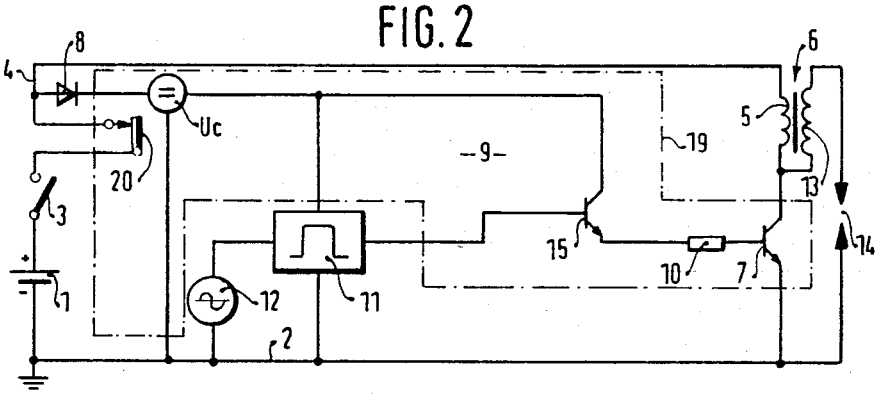
FIGS. 2 and 3 illustrate respective specific embodiments of the invention.

In the ignition system shown in FIG. 2, elements of circuitry which are similar in function and position in the circuit to those shown in FIG. 1 are designated by the same reference numerals. A driver transistor 15 has its base connected to the output of the switching unit 11 and its emitter, via a resistor 10, connected to the base of the output transistor 7. The transistor 15 and resistor 10 comprise part of the constant-current source 9; that is, in order to generate the constant control current in this embodiment, the collector of the driver transistor 15 is connected to a constant-voltage source $U_c$, which in this embodiment is connected to the cathode of the mispolarization prevention diode 8 and to the ground line 2.

The npn driver transistor 15 of FIG. 2 may be replaced with a pnp transistor, with suitable consequential modification, the transistor being controlled in accordance with the stated conditions by the switching unit 11.

It is preferred that a cooling body 19 (i.e. heat sink) be provided for the output transistor 7 and the constant-current source 9. Such a heat sink 19 is generally schematically indicated by dashed lines in FIG. 2. The output transistor 7 and constant-current source 9 are preferably mounted on heat sink 19, which is preferably made of metal. The heat sink 19, and thus the constant-current source 9 and output transistor 7, can then be combined with a heat-sensitive shutoff switch 20, thereby providing a simple shutoff of the ignition system in the event of an overload which results in high temperatures. Shutoff switch 20 is connected in series with main operating switch 3.

Figure 3:
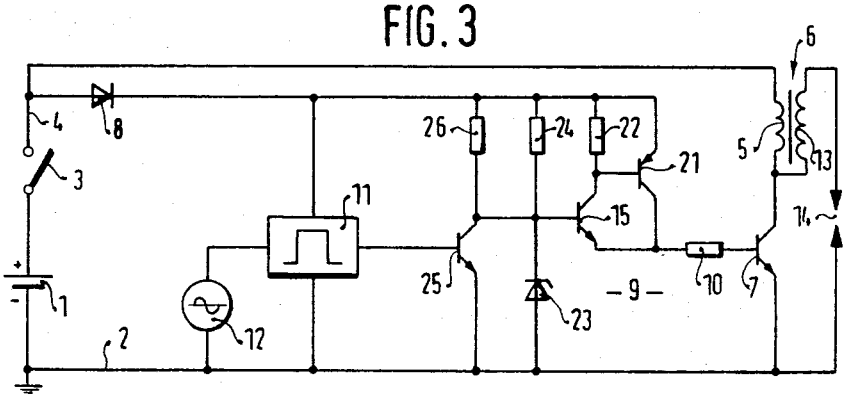

In the circuit of FIG. 3, circuit elements which are similar in function and position in the circuit with those of FIG. 1 or FIG. 2 are again designated by the same reference numerals. In FIG. 3, the driver transistor 15 is a component of a Darlington circuit made up of complementary transistors. A pnp transistor 21 is connected to the driver transistor 15 to form the Darlington circuit. The collector of transistor 21 and the emitter of driver transistor 15 are coupled to resistor 10 which in turn is connected to the base of the output transistor 7. The transistor 21 has its emitter connected to the cathode of the mispolarization prevention diode 8. The collector of the driver transistor 15 is coupled to the base of transistor 21 and, via a resistor 22, likewise to the cathode of diode 8. The base of the driver transistor 15 is coupled to the cathode of a Zener diode 23 connected with its anode to the ground line 2 and also via a resistor 24 to the cathode of diode 8. The base of the driver transistor 15 is further coupled to the collector of an npn transistor 25 and, via a resistor 26, to the cathode of diode 8. The transistor 25 has its emitter connected to the ground line 2 and its base connected to the output of the switching unit 11.

The ignition system of FIG. 3 thus differs from that of FIG. 2 in that, at the instant of ignition, the emitter-collector path of the transistor 25 must be brought into the current-passage state in order to shut OFF the constant-current source 9. That is, the emitter-collector paths of the transistors 15 and 21 must be brought into the blocking state.

Using the Darlington circuit made up of the complementary transistors 15, 21 has the advantage that good current amplification is attained with a relatively low load being placed on the current branch carrying the control current.

In a typical implementation of the circuit of FIG. 2 in an automobile engine, the following parameters apply:

power source 1 = 12 volts range of base current to transistor 7 (current in resistor 10) = 0.75 ampere

We claim:

1. An ignition system for internal combustion engines, comprising:

an output switching transistor (7), the emitter-collector path of which is in a series circuit with the primary winding (5) of an ignition coil (6), control means coupled to the base of said output switching transistor (7) for supplying switching control current to said base of said output switching transistor (7), said control means including a constant-current source (9) for supplying said control current at a current level selected such that, during conduction of said emitter-collector path of said output switching transistor for storing ignition energy in said ignition coil (6), the saturated operation of said output switching transistor (7) is maintained, said constant-current source comprising a driver transistor (15), a resistor (10), and a constant-voltage source ($U_c$) connected in series with the emitter-collector path of said driver transistor (15) and with said resistor (10).

2. The ignition system of claim 1, further comprising an alternating-current signal transducer 12 and a switching unit 11 having an input connected to said signal transducer and an output connected to the base of said driver transistor (15).

3. An ignition system for internal combustion engines, comprising:

an output switching transistor (7), the emitter-collector path of which is in a series circuit with the primary winding (5) of an ignition coil (6), control means coupled to the base of said output switching transistor (7) for supplying switching control current to said base of said output switching transistor (7), said control means including a constant-current source (9) for supplying said control current at a current level selected such that, during conduction of said emitter-collector path of said output switching transistor for storing ignition energy in said ignition coil (6), the saturated operation of said output switching transistor (7) is maintained, wherein said constant-current source comprises a driver transistor (15), a resistor (10), and a constant-voltage source ($U_c$) connected in series with the emitter-collector path of said driver transistor (15) and with said resistor (10) and includes a Darlington circuit comprising complementary transistors (15,21), one of said complementary transistors being said driver transistor (15).

4. The ignition system of claim 3, further comprising an alternating-current signal transducer 12 and a switching unit 11 having an input connected to said signal transducer and an output connected to the base of said driver transistor (15).

5. An ignition system for internal combustion engines, comprising:

an output switching transistor (7), the emitter-collector path of which is in a series circuit with the primary winding (5) of an ignition coil (6), control means coupled to the base of said output switching transistor (7) for supplying switching control current to said base of said output switching transistor (7), said control means including a constant-current source (9) for supplying said control current at a current level selected such that, during conduction of said emitter-collector path of said output switching transistor for storing ignition energy in said ignition coil (6), the saturated operation of said output switching transistor (7) is maintained, a common cooling body (19) for said control means, and a temperature-sensitive shutoff switch (20) thermally coupled to the cooling body (19) for shutting off said ignition system when the temperature of said common cooling body (19) reaches a given level as sensed by said shutoff switch, wherein said constant-current source comprises a driver transistor (15), a resistor (10) and a constant-voltage source ($U_c$) connected in series with the emitter-collector path of said driver transistor (15) and with said resistor (10).

6. The ignition system of claim 5, further comprising an alternating-current signal transducer 12 and a switching unit 11 having an input connected to said signal transducer and an output connected to the base of said driver transistor (15).

* * * * *